US005301446A

United States Patent [19]

Kurtz

[11] Patent Number: 5,301,446

[45] Date of Patent: Apr. 12, 1994

[54] WIND-ACTUATED VEHICLE WARNING SIGN

[76] Inventor: James A. Kurtz, 2343 West Main St., #1067, Mesa, Ariz. 85201

[21] Appl. No.: 73,990

[22] Filed: Jun. 7, 1993

Related U.S. Application Data

[63] Continuation of Ser. No. 764,156, Sep. 20, 1991, abandoned.

[51] Int. Cl.[5] ..... G09F 21/04

[52] U.S. Cl. ..... 40/591; 40/422

[58] Field of Search ..... 40/412, 413, 422, 439, 40/440, 477, 479, 501, 591, 600, 601, 602, 608, 592; 116/41, 45, 51, DIG. 7; 248/596, 597; 404/10, 11

[56] References Cited

U.S. PATENT DOCUMENTS

| | | | |
|---|---|---|---|
| 597,686 | 1/1898 | Milner | 248/597 X |
| 1,532,865 | 4/1925 | Beck | 404/11 |
| 1,566,724 | 12/1925 | Bates | 40/413 |
| 2,302,672 | 11/1942 | Buckley | 40/413 X |
| 2,757,954 | 8/1956 | Hurley | 40/413 X |
| 3,134,184 | 5/1964 | Neblett | 404/11 X |
| 4,038,767 | 7/1977 | Chasin et al. | 40/608 X |
| 4,865,288 | 9/1989 | Dicke et al. | 40/608 X |

*Primary Examiner*—Kenneth J. Dorner
*Assistant Examiner*—J. Silbermann
*Attorney, Agent, or Firm*—David G. Rosenbaum

[57] ABSTRACT

A wind-actuated warning device which mounts onto a vehicle to provide an alert or warning to the operator of a vehicular condition which requires the operator to exert special attention and appropriately respond to the condition. Examples of such conditions include a high profile condition, a roof top carrier or a reminder to deploy landing gear on an aircraft. The warning device has a base member with coupling for mounting the base member onto the vehicle. The warning device further has a cover member pivotally mounted to the base member. The cover member has a frontal and a rearward surface with a warning or other indicator associated with the rearward surface of the cover. The cover is biased against the base, which is overcome by wind loading to pivotally collapse the cover onto the base and provide a substantially flat elevational profile of the warning device on the vehicle.

14 Claims, 2 Drawing Sheets

WIND-ACTUATED VEHICLE WARNING SIGN

This is a continuation of copending application(s) Ser. No. 07/764,156 filed on Sep. 20, 1991 now abandoned.

BACKGROUND OF THE INVENTION

The present invention relates generally to warning devices for mounting onto vehicles to provide the vehicle operator with a visible reminder, warning, or notification of a danger or potential danger situation. More particularly, the present invention relates to a wind-actuated sign which mounts onto the vehicle to alert or warn the operator of a condition which requires a response from the operator.

Many vehicles, especially motor vehicles such as automobiles, motor homes, trucks and trailers, either carry additional loads on the roof-top which present a high-profile or have a permanent highprofile created by the height of the truck or trailer. For example, many automobile drivers carry luggage racks or car top carriers for mounting bicycles, boats, skis, or other items for carriage. The mounting of these additional items onto the roof of the motor vehicle results in the motor vehicle obtaining a higher profile. Additionally, may drivers rent moving trailers or motor homes which have a permanent higher profile than the driver's automobile.

The higher profile of the vehicle is often times an unusual condition for the vehicle operator and presents a potential danger for collision with overhead obstructions, such as the top of an underpass, the roof of a gasoline station, the top of a garage doorway, etc. Of course, damage will usually result to the vehicle or to the items being carried on top of the motor vehicle which may collide with the obstruction.

Various types of warning devices for mounting onto motor vehicles are known in the prior art. For example, U.S. Pat. No. 3,141,253, issued to Bartram in 1964, discloses an automobile driver signalling device which consists of a mounting plate to mount the device onto a vehicle dashboard. A sign or other indicator is pivotally mounted to the end of a stem or upstanding stalk. The upstanding stalk is, in turn, pivotally mounted to a base member secured to the vehicle dashboard. The sign or other indicator is pivotally mounted onto the stalk and may be fitted with a coil spring to facilitate the driver raising or lowering of the sign. The principal disadvantage of this device is that it requires the driver to actuate the device. This causes the driver to have a momentary inattention to the driver's responsibilities for operating the vehicle. The device also is a permanent fixture on the vehicle dashboard which tends to obstruct the driver's view during operation of the vehicle.

Similarly, U.S. Pat. No. 3,237,330, issued to Dinstbir in 1966, also discloses a dashboard-mounted warning device which consists of a suction cup base and a sign which is rotatably mounted in a bore or recess in the suction cup base. Like the Bartram patent, this device is a dashboard-mounted device, and suffers from the same disadvantages noted above. As with many suction cup devices, the mounting is unstable and the sign may often times fall off the dashboard when the suction or vacuum is lost and the suction cup releases. Release of the device from the dashboard will divert the driver's attention from the road and possibly endanger the driver or other drivers.

U.S. Pat. No. 3,678,456, issued to Gruber in 1972, discloses a vehicle-mounted warning device which consists of a spring-loaded telescoping arm mounted in the trunk fender with a remote linkage to the driver position. The telescoping arm has two elements which are movable relative to each other, one element being fixed to the vehicle and the other element being moveable between a retracted and extended display position. Movement of the telescoping arm is actuated by a spring which extends the telescoping arm to provide a warning signal, such as a warning flag to evidence that the vehicle is in motion. The spring may be deployed via actuation of the remote control linkage by the driver. While this type of warning device is instrumental for others viewing the movement of the vehicle, it does not provide for any consistent warning to the vehicle operator that the vehicle is carrying a load which renders the vehicle a high profile vehicle and susceptible to collision with overhead obstructions.

U.S. Pat. No. 3,703,152, issued to Morton in 1972, discloses a distress signalling device which has a storage housing for storing a triangular-shaped and foldable distress signal. One element of the foldable signal is a hook which is provided on the housing to mount the device onto a vertically-adjustable window of the vehicle. In its deployed condition, the device projects laterally from the window of the motor vehicle to provide warning to approaching vehicles of the stalled or distressed condition of the motor vehicle. The device of this patent would not be suitable for a warning to the driver of the distressed vehicle of a high profile load condition during operation of the motor vehicle.

U.S. Pat. No. 3,769,931, issued to Babut, et al., in 1973, discloses a low overhead warning signal device which is mounted on the front of a truck cab. The signal device consists of a steel rod which extends upwardly from a support arm mounted to the truck cab. The upper end of the steel rod supports a feeler wire which extends above the top of the truck body, and is deflected upon encountering an overhead obstruction to emit a rubbing sound to warn of the obstruction. While this type of system provides the necessary warning upon encountering an obstruction, it would not adequately serve to remind the driver on a continual basis of the high profile condition of an ordinary automobile.

U.S. Pat. No. 4,132,022, issued to Wood, Jr. in 1979, discloses a dashboard-mounted sign to remind the driver in accordance with a message carried on the device. The device mounts on the dashboard and reflects an inversely-written message upwardly onto the inside of a windshield for viewing and reading by the driver. The principal disadvantage of this sign is that it provides a constant reflection on the windshield which would be a distraction to the driver and is not removed from the field of view during operation of the vehicle at normal speeds. Moreover, varying angles of windshield position would alter the relative position of the reflection on the windshield and the reflection may or may not be in an optimal position for viewing the field of operation for the motor vehicle.

U.S. Pat. No. 4,783,352, issued to Kaiser, Jr. in 1988, discloses a hood-mounted thermometer which is placed on the vehicle hood in the field of vision of the driver. The device is meant to be permanently mounted, either by gluing or by bolting onto the hood of the vehicle. This device is illustrative of types of hoodmounted ornaments or functional indicators which are mounted external to the driver's cabin, on the hood of the vehicle.

U.S. Pat. No. 4,827,646, issued to Miller, et al. in 1989, discloses a vehicle sign device which provides a variable height support structure adjustable by a scissor action. The device is meant to carry a removable and interchangeable message card and coupled to the interior window sill of a motor vehicle for extension and retraction to carry messages, such as sales messages. This type of sign is not suitable for mounting in the driver's field of view, nor could it be used exterior to the passenger compartment during operation of the motor vehicle.

Finally, U.S. Pat. No. 4,888,893, issued to Jones in 1989, discloses a vehicle distress sign which consists of a base member fitted with a magnet to mount onto an automobile, the base having a plurality of upstanding support members each fitted with one-half of a hook and loop material. A distress sign, such as "out of gas" is provided with a corresponding other half of the hook and loop material. In use, the user mounts the magnetic base onto the motor vehicle and then mounts the warning sign onto the upstanding support members by engaging the hook and loop material. While this patent illustrates a type of removable magnetic sign, the construction of it would not permit its use on the hood of a motor vehicle while the motor vehicle is being operated at normal speeds to warn of a high profile or of potential obstruction conditions.

From the foregoing, those skilled in the art will appreciate that there are no wind-actuated warning devices which are easily adaptable for removable mounting onto the vehicle within the operator's field of vision, which are in a collapsed or a closed condition during normal speed operation of the vehicle, but which, upon slowing of the vehicle and reduction of a wind load on the sign, open to provide the vehicle operator a warning of a vehicular condition which requires the operator to exert special attention and respond to the condition, such as a high profile condition for the motor vehicle. For example, a high profile condition warning reminds the driver that the driver is operating a high profile vehicle and to take heed of any overhead obstructions which may serve to damage the vehicle or items being carried in the overhead load.

It is known in the art to provide various types of spring- or bias-loaded signs which are capable of receiving a wind load and deflecting and returning to an unbiased upstanding position upon reduction of the wind load. Examples of such signage are found in U.S. Pat. No. 3,646,696, issued to Sarkisian on Mar. 7, 1972, U.S. Pat. No. Re. 32,359, issued to Seely in 1987, and U.S. Pat. No. 4,783,921, issued to George in 1988. Each of the foregoing relate to either portable or permanent-mounted signs which have either a flexible sign material or which have a spring mounting to receive the deflection of the supported sign under a wind load. None of these patents are readily adaptable to nor are suggested to have utility in mounting directly onto an automobile hood.

Accordingly, there has been recognized a need for a removably mountable wind-actuated warning sign capable of being mounted onto a vehicle within the field of vision of the motor vehicle operator. Optimally, the device would have a low profile in its closed or retracted position so that there is a minimal obstruction of the driver's field of vision at normal vehicle speeds, such as over approximately 15 m.p.h. However, when the vehicle slows to approximately less than 15 m.p.h, the wind load on the sign decreases and the sign is returned to an unbiased raised or deployed position whereby the driver would be reminded of vehicular condition which requires the driver to exert special attention to the stated condition, such as a high profile condition of the motor vehicle.

SUMMARY OF THE INVENTION

According to a broad aspect of the present invention, there is provided a wind-actuated warning device capable of removably mounting onto a vehicle, such as an automobile, motor home, truck or trailer, within the operator's field of vision and which presents a low profile on the vehicle hood to minimize obstruction in the driver's field of vision during normal operation of the motor vehicle. However, when the vehicle slows and the wind loading on the warning device is lessened, the warning device opens to provide a reminder, warning or notice to the driver of a condition or potential danger which requires the driver to exert special attention and respond appropriately in view of the condition.

According to a more specific aspect of the invention, the warning device is comprised of a base member having a coupling, such as a magnet or a track and mating flange, for removably mounting the base member onto the vehicle. The device further has a cover member pivotally mounted to the base member. The cover member has a frontal and a rearward surface with a warning or other indicator associated with the rearward surface of the cover. The cover is biased, via a spring or other biasing means such that the bias is overcome by wind loading to pivotally collapse the cover member onto the base member and provide a substantially flat elevational profile of the warning device on the hood of the motor vehicle.

It is a further aspect of the invention to configure the warning device with an aerodynamic profile which has a tapered leading edge or an air foil member to receive the wind load from the front of the vehicle and deflect the wind load onto the frontal surface of the cover member, thereby causing the cover member to close over the base member. The cover member will have a leading and a trailing surface, relative to the wind flow, the trailing surface optionally having an air foil associated with it to stabilize the cover member in the closed position. The aerodynamic profile of the warning device will facilitate a secure magnetic coupling between the device and the vehicle to ensure that the wind loading on the device does not displace the device from the vehicle.

These and other objects, features and advantages of the present invention will be more apparent to those skilled in the art from the following more detailed description of the present invention with reference to the preferred embodiments thereof taken with the accompanying figures, in which like features are identified by like reference numerals.

DETAILED DESCRIPTION OF THE PREFERRED EMBODIMENT

Figure 1:
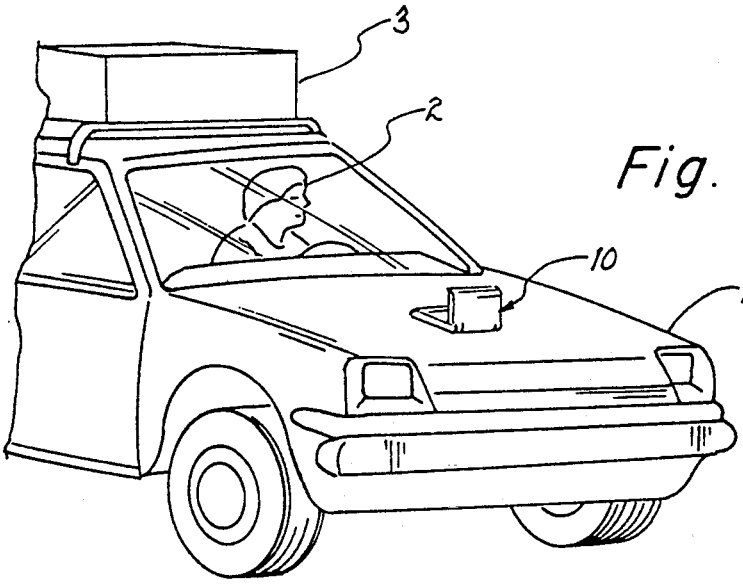
FIG. 1 a partial perspective view of an automobile illustrating attachment of the warning device of the present invention onto the hood of the vehicle.
Figure 2:
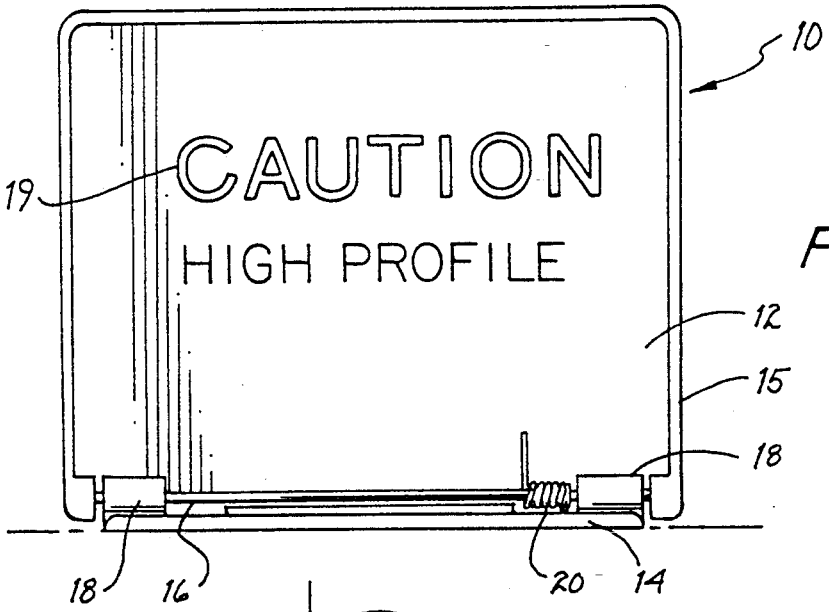
FIG. 2 is a rear elevational view of the warning device of the present invention illustrating the device in the non-wind loaded open condition.

In accordance with the preferred embodiment of the present invention and with particular reference to FIG. 1, there is shown the wind-actuated vehicle warning device 10 in accordance with the present invention. Those skilled in the art will understand, from the following description, the present invention has utility with a wide range of vehicles, such as automobiles, motor homes, trucks, trailers or aircraft and that a variety of alternative warning indicators, or other messages, may be affixed to the warning device 10, as is appropriate for the particular vehicle. The high profile reminder or warning is referred to as a non-limiting example of a contemplated use of the invention. Alternative contemplated uses include, without limitation, mounting in an aircraft nose cowling to provide a reminder to check that the landing gear is down or mounting on a rental trailer to remind the driver of the height of the trailer.

Warning device 10 is preferably positioned in view of the motor vehicle operator 2 and is removably mounted onto the hood of the motor vehicle 1. Warning device 10 is, for example, used to provide notice to the driver of the presence of a high profile load 3, such as a car top carrier, sports equipment, camping equipment, bicycles, or the like, which may be mounted onto a car top carrier. As noted above, an often-encountered problem with the carriage of car top-mounted load 3 is the driver or motor vehicle operator forgetting of the car top load and colliding with a low overhead obstruction, such as a garage door, service station roof, or overhead pass, which causes damage to the car top load 3.

Turning now to FIGS. 2–6, warning device 10 consists of a generally planar base member 14 and a generally planar cover member 15. Base member 14 is removably mounted to the hood of the vehicle 1 by a removable coupling 13. Removable coupling 13 preferably consists of at least one magnet having a sufficient magnetic flux to securely mount the warning device 10 onto the hood of the motor vehicle and retain the warning device 10 in a stationary position on the motor vehicle during normal operational speeds. Those skilled in the art will appreciate that other types of couplings may be employed, such as a track and mating flange, as are known in the art. For purposes of illustration only, it has been found that the present invention, when used with the magnetic coupling 13, is stable on the hood of the motor vehicle at speeds up to and including approximately 70 m.p.h.

Figure 4:
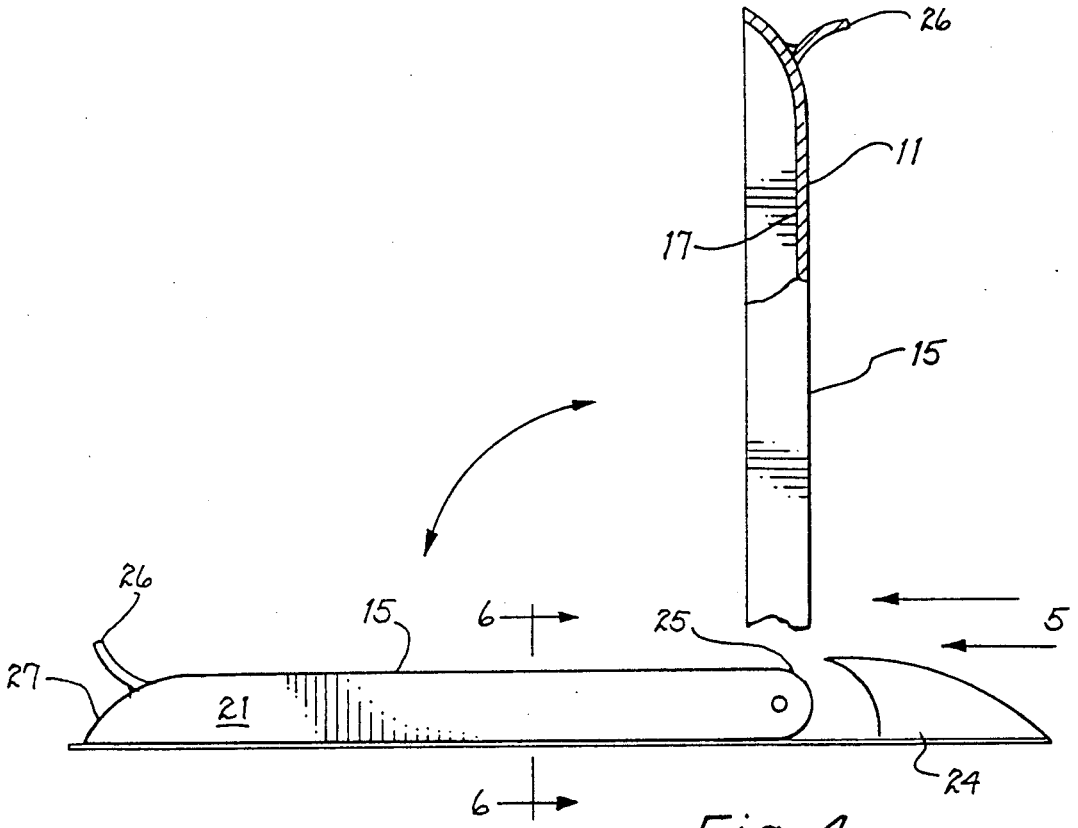
FIG. 4 is a side elevational view illustrating the wind-actuated warning device of the present invention in its open and closed position.

Each of base member 14 and cover member 15 have a leading and a trailing edge relative to the wind flow 5 illustrated in FIG. 4. The leading edge 25 of the cover member 15 is pivotally coupled to the leading edge of the base member 14 such that the cover member 15 pivotally opens and closes on top of covers over the base member 14. In accordance with a preferred embodiment of the invention, cover member 15 has tapered or curved leading and trailing edges, 25 and 27, respectively, to facilitate an aerodynamic profile to the wind load 5. Cover member 15 further comprises a frontal surface 11 and a rearward surface 17. Rearward surface 17 forms a recess 31 defined by the leading 25 and trailing 27 edges of the cover member and by side members 21 which are substantially perpendicular to the plane of the forward surface 11. The recess 31 forms a cavity which accommodates the base member 14 when the cover member is in its closed condition over the base member 14.

An abutment 22 may be provided in association with base member 14. Abutment 22 projects vertically in close proximity to the leading edge of the base member and is preferably of a sufficient height to reside adjacent to the rearward surface 17 of the cover member 15, when the device 10 is in the closed condition. Without abutment 22, it has been found that back pressure develops on the rearward surface 17 due to air flow 5 impinging under the leading edge 25 of the cover member 15. This back pressure destablizes the forward pressure on the forward surface 11 of the cover member 15 which causes flapping of the cover member 15. Abutment 22 serves to restrict air flow 5 from impinging under the leading edge 25 of the cover member 15 and into the recess 31 of the cover member 15. By restricting air flow 5 from entering recess 31, deleterious back pressure on the rearward surface 17 of cover member 5 is minimized, if not entirely eliminated.

Figure 3:
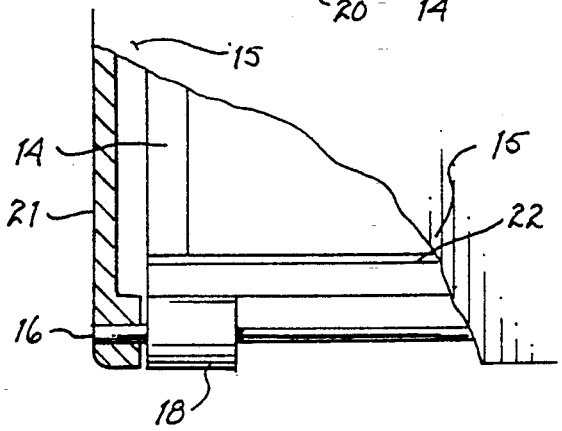
FIG. 3 a fragmentary partial cutaway partial cross-sectional view illustrating engagement between the base member and the cover member of the warning device of the present invention.
Figure 5:
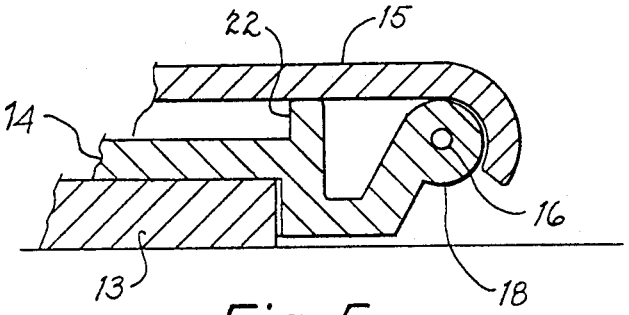
FIG. 5 is a side elevational cross-sectional fragmentary view of the connection between the base member and the cover member in accordance with the present invention.
Figure 6:
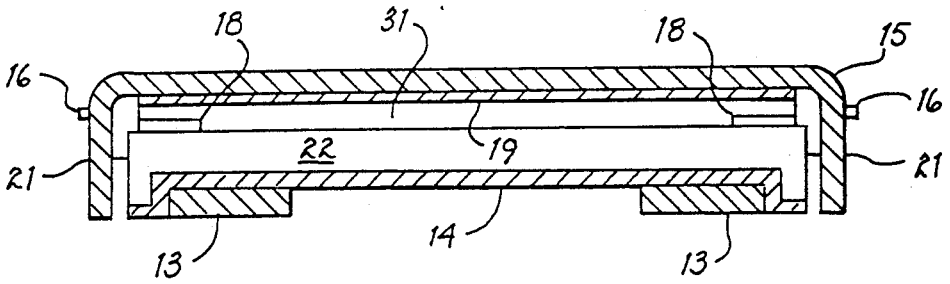
FIG. 6 is an end elevational cross-sectional view taken along line 6—6 of FIG. 4.

Base member 14 is preferably configured with a hinge 18 associated with the leading edge of the base member 14 to pivotally couple the cover member to the base member. As illustrated in FIGS. 3, 5 and 6, hinge 18 may consist of a pin-receiving socket 18 which receives hinge pin 16 which couples to a side member 21 of the cover member 15 to provide a pivoting action between the cover member 15 and the base member 14. A biasing spring 20 is operably associated with the hinge pin 16 to provide a biasing force between the base member and the cover member. The bias force provide by biasing spring 20 is overcome upon wind loading of the cover member 15 to collapse the cover member 15 and cover the base member 14 under wind loaded conditions. Conversely, the biasing spring 20 will serve to open the cover member 15 when the wind load is reduced and the bias of the spring is no longer overcome by the wind load 5. Biasing spring 20 may be selected to have various strengths, which are selected based upon the desired wind load pressure required to close the cover member 15. According to the best mode contemplated for the invention, however, it has been found desirable to provide a biasing spring 20 which will withstand a nominal wind load of 15 m.p.h. before being overcome resulting in closing of cover member 15. Those skilled in the art will understand, however, that the strength of biasing spring 20 is a matter of design choice.

A warning indicator 12 is associated the rearward surface 17 of the cover member 15. The sign may contain any message 19 which is necessary to warn of an unusual condition of the motor vehicle. Warning indicator 12 may be a discrete sign affixed to the rearward surface 17 of cover member 15, such as by adhesive or the like, or may be imprinted directly on the rearward surface 17, as is understood in the art.

In an alternative preferred embodiment of the invention, as illustrated in FIG. 4, the base member 14 has associated with it a leading air foil 24. Leading air foil 24, if provided, is preferably molded as part of the base member 14. Leading air foil 24 forms a generally tapered leading surface to deflect the wind load 5 toward the forward surface 11 of cover member 15 to provide an actuating force to overcome biasing spring 20 and close cover member 15 onto the base member 14. Additionally, the cover member 15 may have an trailing air foil 26 associated with the trailing edge 27 of the cover member 15 to receive the wind load 5 and stabilize the cover member 15 in the closed condition. Provision of the leading air foil 24 and the trailing air foil 26 may minimize the need for abutment 22 by streamlining the air flow 5 across the outer surface of cover member 15 and minimizing impinging air flow under the leading edge 25 of cover member 15. Accordingly, where air foils 24 and/or 26, or other equivalent means to streamline the aerodynamic profile of warning device 10, abutment 22 may be optionally eliminated.

Those skilled in the art will appreciate, from the foregoing description of the present invention with reference to its preferred embodiments, that the present invention provides a windactuated vehicle warning device in accordance with the objects of the present invention. Specifically, the above-described device is well-suited for removable mounting onto the hood of a vehicle within the field of vision of the vehicle operator. Moreover, above-described warning device 10 is well-suited to providing a wind load-actuated opening and closing of the device for visually warning the driver of an unusual condition of the vehicle, such as a high profile condition or a high profile carriage load on or associated with the vehicle. Further, by providing a base member 14 which stabilizes the device through a removable connection 13, such as a magnet, onto the hood of a vehicle 1, and a cover member 15 pivotally coupled via a biasing spring 20 or other biasing mechanism, the cover member is deformed into its closed condition upon wind loading, and released from its closed condition during a reduction in the wind load to provide visual notice to the driver of the unusual vehicle condition. Further, the additions of the leading and trailing edges of each of the base and cover members facilitate a low profile, substantially aerodynamic configuration for the device which enhances stability at low and at high speed.

While the invention has been described with reference to the preferred embodiments thereof, those skilled in the art will understand that variations in design, detail and choice of materials for manufacture may be made and still fall within the spirit and scope of the present invention, which is intended to be limited only by the claims appended hereto.

What is claimed is:

1. A vehicle warning device, comprising:

a generally flat planar base member having a tapered leading edge forming an air foil;

a planar cover member having a forward surface, a rearward surface, side surfaces and a recess defined by said rearward surface and said side surfaces;

sign means for providing a visual notice, said sing means being associated with said rearward surface of said planar cover member;

fine means for movably coupling said planar cover member to said generally flat planar base member;

biasing means or imparting a biasing force to said planar cover member, said biasing force being overcome by an external wind load acting upon said forward surface of said planar cover member thereby actuating closing of said planar cover member onto said generally flat planar base member and, upon unloading of the external wind load overcoming said biasing force, said biasing force actuating raising of said planar cover member to a substantially vertical position relative to said generally flat planar base member; and means or mounting said planar base member onto a vehicle.

2. The device of claim 1, wherein each of said generally flat planar base member and said planar cover member further comprise leading and trailing edges thereof, said leading edge of said planar cover member and said leading edge of said generally flat planar base member each having said means for movably coupling said planar cover member to said generally flat planar base member operably associated therewith.

3. The device of claim 1, wherein each of said generally flat planar base member and said planar cover member further include at least one of said hinge means pivotally interconnecting said planar cover member to said generally flat planar base member.

4. The device according to claim 1, wherein said planar cover member further comprises signage associated with a rear surface of said planar cover member.

5. The device according to claim 4, wherein said signage further comprise a warning signal.

6. The device according to claim 4, wherein said biasing means for imparting a biasing force further comprises a spring.

7. The device according to claim 1, wherein said planar cover member further comprises an air foil associated with a trailing edge of said planar cover member.

8. The device according of claim 1, wherein said air foil further comprises a raised trailing edge, said air foil receiving a wind load and deflecting the wind load onto said planar cover member.

9. A wind actuated warning apparatus, mountable external to a passenger compartment of a vehicle and within the field of vision of a vehicle operator, comprising:

i. a generally flat planar base member comprising
   a. means for mounting said generally flat planar base member onto the vehicle;
   b. means for deflecting air flow over said generally flat planar base member;

ii. a planar cover member comprising
   a. a forward surface, a rearward surface and side surfaces;
   b. a recess defined by said rearward surface and said side surfaces;
   c. signage associated with said rearward surface of said planar cover member; and iii. hinge means for movably coupling said planar cover member to said generally flat planar base member; and iv. biasing spring means for biasing said planar cover member against said generally flat planar base member, said biasing spring means generating a biasing force against said planar cover member which is overcome by an external wind load impinging upon said forward surface of said planar cover member thereby causing said planar cover member to close onto said generally flat planar base member, said biasing force against said planar cover member also being sufficient to open said planar cover member to a substantially vertical position upon unloading of said external wind load from said forward surface of said planar cover member.

10. The apparatus of claim 9, wherein said hinge means for movably coupling said generally flat planar base member and said planar cover member further comprises at least one hinge member for pivotally interconnecting said planar cover member to said generally flat planar base member.

11. The apparatus according to claim 9, wherein said planar cover member further comprises an air foil associated with a trailing edge of said planar cover member.

12. The apparatus according to claim 9, wherein said means for deflecting an air flow associated with said generally flat planar base member further comprises a forwardly extending air foil.

13. The apparatus according to claim 12, wherein said forwardly extending air foil further comprises a tapered leading edge and a raised trailing edge, said air foil receiving a wind load and deflecting the wind load onto said planar cover member.

14. The apparatus according to claim 9, wherein said means or deflecting an air flow over said generally flat planar base member further comprises an abutment projecting vertically and generally perpendicularly from said generally flat planar base member and positioned in close proximity to a leading edge of said generally flat planar base member.

* * * * *